US006762373B2

(12) United States Patent
Matsuo

(10) Patent No.: US 6,762,373 B2
(45) Date of Patent: Jul. 13, 2004

(54) COMPACT ROTARY ATTENUATOR

(75) Inventor: Yasuhiro Matsuo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 85 days.

(21) Appl. No.: 10/273,920

(22) Filed: Oct. 21, 2002

(65) Prior Publication Data

US 2003/0075421 A1 Apr. 24, 2003

(30) Foreign Application Priority Data

Oct. 22, 2001 (JP) ..... 2001-323773

(51) Int. Cl.[7] ..... H01H 21/00; H01H 1/12; H01H 19/00

(52) U.S. Cl. ..... 200/11 DA; 200/11 R; 200/504; 333/106

(58) Field of Search ..... 200/11 R–11 TW, 200/504; 333/81 R, 262, 101–108; 335/4, 5

(56) References Cited

U.S. PATENT DOCUMENTS 2,481,649 A * 9/1949 Doucette ..... 200/11 A
2,484,126 A * 10/1949 Smith, Jr. ..... 200/11 K
2,601,372 A * 6/1952 Creaser, Jr. ..... 200/504
3,303,296 A * 2/1967 Scott ..... 200/11 H
3,652,812 A * 3/1972 Ristuccia ..... 200/11 TC
3,940,584 A * 2/1976 Cauldwell et al. ..... 200/504
4,146,853 A * 3/1979 Kiyono et al. ..... 333/81 R
6,353,195 B1 * 3/2002 Stanfield ..... 200/11 R

FOREIGN PATENT DOCUMENTS

JP 2000-294410 10/2000

* cited by examiner

*Primary Examiner*—James R. Scott
(74) *Attorney, Agent, or Firm*—Kanesaka & Takeuchi

(57) ABSTRACT

A compact rotary attenuator comprises a housing (1), a terminal board (3) having input and output terminals (20A and 20B) and electronic components connected between the input and output terminals, a driving shaft (13) attached to the terminal board (3) at right angles therewith within the housing (1), input and output contact shoes (11 and 12) for spring contact with the input and output terminals (20A and 20B), and input and output coaxial connectors (9 and 10) each having a central conductor extending into the housing (1), wherein the input and output contact shoes (11 and 12) make contact with the input and output terminals (20A and 20B) on different sides of the terminal board (3).

7 Claims, 6 Drawing Sheets

COMPACT ROTARY ATTENUATOR

BACKGROUND OF THE INVENTION

1. Field of the Invention

The present invention relates to a rotary attenuator device.

2. Description of the Related Art

This type of device has been publicly known, for example as disclosed in Japanese Unexamined Patent Publication No. 2000-294410. This device has been often used as illustrated in the accompanied figure, FIG. 5, by arranging a plurality of devices 50 in one electronic device. Each rotary attenuator device 50 has a disk-shaped terminal board 52 which can rotate in a housing 51. The disk-shaped terminal board is driven by stepwise rotational movement for a specified angle through operating a dial (not illustrated) mounted at a driving shaft 53 which protrudes outside of the housing 51. Plural pairs of input and output terminals are locally arranged on one side of the terminal board 52. Also, an input coaxial connector 54 and an output coaxial connector 55 are provided on a side of the housing 52, which is opposite to the side where the driving shaft 53 is provided.

As illustrated in FIG. 6, contact shoes 56 and 57 respectively contact with input terminal 58 and output terminals 59 of a pair in the housing, and come to respectively contact with input terminals 58' and output terminals 59' of another pair once the terminal board rotates stepwise in one direction or another direction. Here, the contact shoes 56 and 57 are respectively connected to the central conductor of the connectors 54 and 55. The contact shoes 56 and 57 of the input and output coaxial connectors 54 and 55 are made similar each other.

As illustrated in FIG. 7, the contact shoe 56, for example, is made by bending a metal sheet band, such that the sheet surface of the bent part is parallel to the surface of the non-bent part. Therefore, it looks like a U-shape skid for the shaft 56A, which is connected to the central conductor. The contact shoe 54 extends along circumferential direction on the terminal board, e.g. a direction towards its adjacent input terminal 58'. The contact shoe 54 elastically contacts with the input terminal by its elasticity, and comes to contact with the adjacent input terminal with its rounded end, e.g. the rounded bottom part of the U-shape. Such contact shoe is also provided to the output coaxial connector.

As described above, in the publicly known device, since the pair of input and output terminals 58 and 59 respectively contact with the contact shoes 56 and 57 at one side of the terminal board, e.g. on the same side of the terminal board 52, the pair of the input and output terminals 58 and 59 cannot be provided too close to each other. Therefore, the input and output coaxial connectors 54 and 55 need to be arranged in more distant positions. Accordingly, the distance between the input terminal and the output terminal needs to be set relatively large. If plural pairs of both terminals are arranged along the circumference on the terminal board 52, the terminal board 52 becomes large. Consequently, if a plurality of the rotary attenuator devices 50 are arranged as illustrated in FIG. 5, the total width L becomes extremely large. That is, it is not avoidable that the electronic device, in which this rotary attenuator device is used, becomes even larger.

Moreover, since the possible elastic displacement of the conventional contact shoe of FIG. 7 is small, the allowable amount for errors in the displacement is small. In other words, it is hard to stabilize the contact. Furthermore, because of its shape, the contact shoe smoothly contacts with the terminal when the terminal board rotates in one rotational direction, but when the terminal board rotates in the opposite direction, the contact shoe is often caught by the terminal and also, the contact tends to be unstable.

SUMMARY OF THE INVENTION

Accordingly, it is an object of the present invention to provide a compact rotary attenuator which does not make the electronic device large when it is used in plural.

According to the invention there is provided a compact rotary attenuator which comprises the terminal board, on which plural pairs of input and output terminals are provided along its circumference and an electronic part including resistance are provided between the input and output terminals of each pair; the driving shaft which is joined to the center of the terminal board in the housing to be vertical to the surface of the terminal board and held so as to rotate; input and output contact shoes which elastically contact with input and output terminals of each pair by its freely sliding movement, and input and output coaxial connectors being held by the housing and having the central conductor extending to the inside of the housing.

In the rotary attenuator of the present invention, the first aspect of the invention is featured by that the input contact shoe and the output contact shoe are provided on different sides of the terminal board to contact with corresponding input terminal and output terminal.

According to the first aspect of the invention, since the input terminal and the output terminal are provided on the opposite side of the terminal board to the other, both can be arranged in adjacent position along the circumference of the terminal board, no matter with the size of its head portion. Therefore, the distance along the circumferential direction can be short when the plural pairs of the input terminal and the output terminal are arranged. Accordingly, the distance in a radial direction for the arrangement on the circuit board can be small. As a result, the terminal board can be small in its size, and also the attenuator device can be small in its size.

According to the present invention, it can be designed that the input contact shoe and the output contact shoe are provided at one end of a respective elastic arm, which is formed like a cantilever, extends in the radial direction of the terminal board, and contacts with the central conductor of the coaxial connector and held at the other end. By doing this, since the contact shoe extends in a radial direction of the terminal board, only the size of the contact shoe needs to be considered in a circumferential direction of the terminal board. There is no need to secure space for elastic arm to hold the contact shoe, and the distance between the terminals can be small. For those reasons, the device can be small in its size even on this point.

In the present invention, the housing has a pair of flat outer surfaces, which are parallel and face each other. If each axis of the driving shaft, the input coaxial connector and the output coaxial connector is supposed to be in a surface parallel to the pair of outer surfaces, a plurality of the attenuators can be arranged by contacting the outer surfaces together, so that total width can be made shorter.

The second aspect of the invention is featured by that the housing has the pair of flat outer surfaces, which are parallel and face each other. And all the axes of the driving shaft, the input coaxial connector and the output coaxial connector are in one surface parallel to the pair of the outer surfaces. Since all the axes of the driving shaft, the input coaxial connector and the output coaxial connector are in one surface parallel to the pair of the outer surfaces, the attenuator can be made even smaller than the one in the first invention. Therefore, the total width in a direction of arranging the attenuators become extremely small when plural attenuators are arranged. Therefore, the device, in which the attenuator is used, can be also designed to be smaller. It can be made that the input contact shoe and the output contact shoe are provided on one end of respective elastic arm, which is formed like a cantilever and extends in a radial direction of the terminal board. Here, the elastic arm is connected with the central conductor of the coaxial connector and held thereby.

DESCRIPTION OF THE PREFERRED EMBODIMENTS

Figure 1:
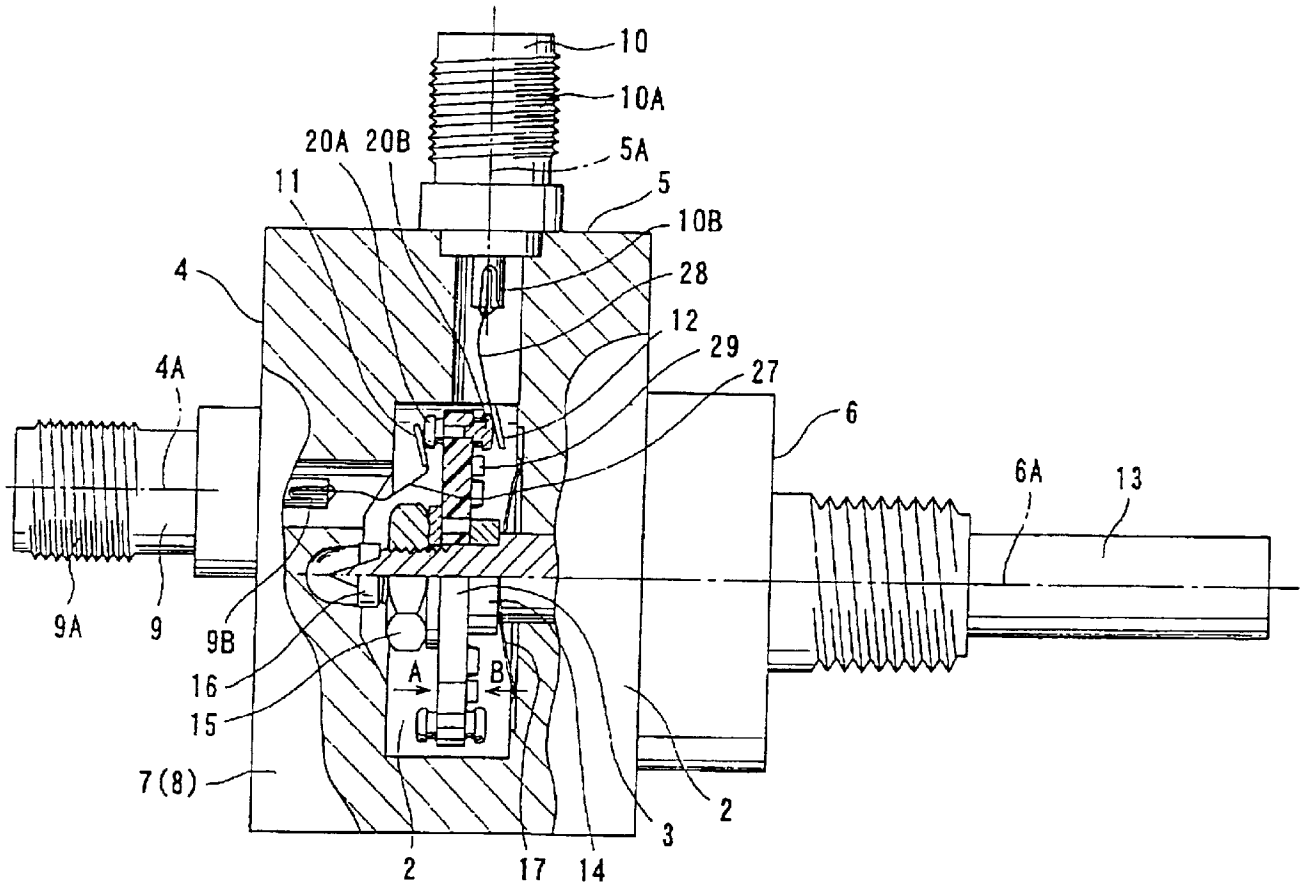
FIG. 1 is a partially cutout, side view of a rotary attenuator according to an embodiment of the present invention, including input and output coaxial connectors and a driving shaft.

In FIG. 1, the rotary attenuator has a disk-type terminal board 3 in a hollow chamber 2 of a housing 1 which is a block-shaped metal. It is not illustrated in the figure, but the housing 1 itself can be disassembled into several parts, so that the attenuator device can be assembled by first placing the terminal board 3 in the hollow chamber 2, as illustrated in FIG. 1, and then covering the terminal board. The housing 1 has outer surfaces 4, 5, and 6, which are respectively vertical to axes 4A, 5A, and 6A. The axes 4A, 5A, and 6A are vertical or parallel each other in a paper surface of FIG. 1. Also, the housing 1 has a pair of flat outer surfaces 7, 8, which are parallel to the paper surface of FIG. 1 (In FIG. 1, one of the flat outer surfaces 7 is illustrated, and the other outer surface 8 is located on the backside of the paper of the figure). Accordingly, the housing 1 has substantially rectangular parallelepiped block shape. In this invention, the outer surface does not have to be flat, and can be optionally any shape.

Coaxial connectors 9 and 10 are respectively attached to the outer surfaces 4 and 5 of the housing 1. As for those coaxial connectors 9 and 10, one is used as input coaxial connector, and the other is used as the output coaxial connector. The coaxial connectors 9 and 10 respectively have screw portions 9A and 10A, respectively, to connect with the coaxial cable outside the housing. Also, the coaxial connectors 9, 10 have central conductors 9B, 10B protruding into the housing. The central conductors 9B, 10B hold the contact shoes 11, 12. The contact shoes are described below in detail. The driving shaft 13 extends outward from the outer surface 6 of the housing 1, and the dial (not illustrated) can be attached outside the housing to rotationally drive the driving shaft 13 around the axis 6A. The driving shaft 13 also protrudes into the housing 1, and supports the terminal board 3 at its center position. The mutual positioning and attachment of the terminal board 3 and the driving shaft 13 are done by the spacer 14, the nut 15, and so on. The driving shaft 13 and the housing 1 are electrically connected by a spring washer 16 and a sliding member 17.

Figure 2A:
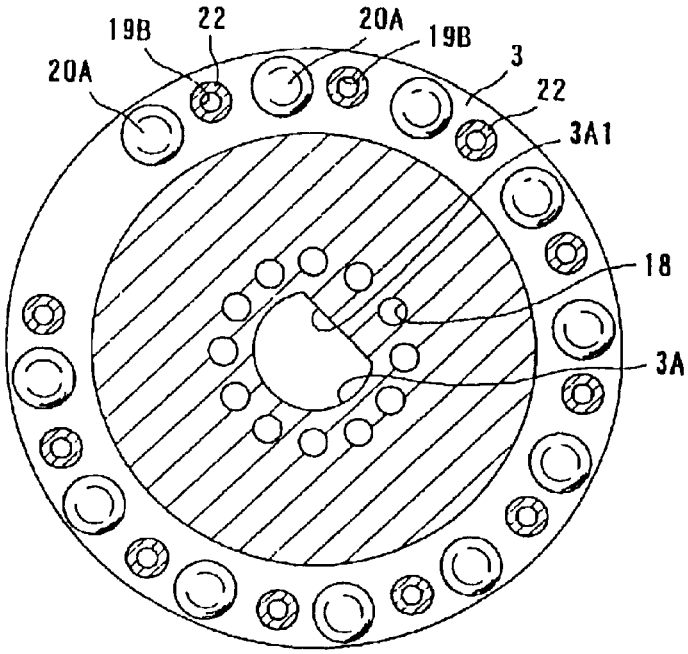
FIGS. 2(A) and (B) are front and back views of a terminal board for the attenuator viewed in a direction of arrows A and B, respectively.

In FIGS. 2(A) and (B), the terminal board 3 is disk-shaped, and has a D-shaped shaft hole 3A at its center, in which the driving shaft 13 goes through. The driving shaft 13 is stopped in the circumferential direction by the straight inner area 3A1 of the D-shaped shaft hole. A plurality of holes 18 is provided along the circumference of the shaft hole 3A, and used for putting wiring through from both sides of the terminal board if required. A plurality of pairs of terminal holes 19A and 19B are provided along the outer circumference of the terminal board 3. The terminal 20A is provided at one terminal hole 19A, extruding outward from one side of the terminal board, while the terminal 20B is provided at the other terminal hole 19B, extruding outward from the other side of the terminal board.

Figure 2B:
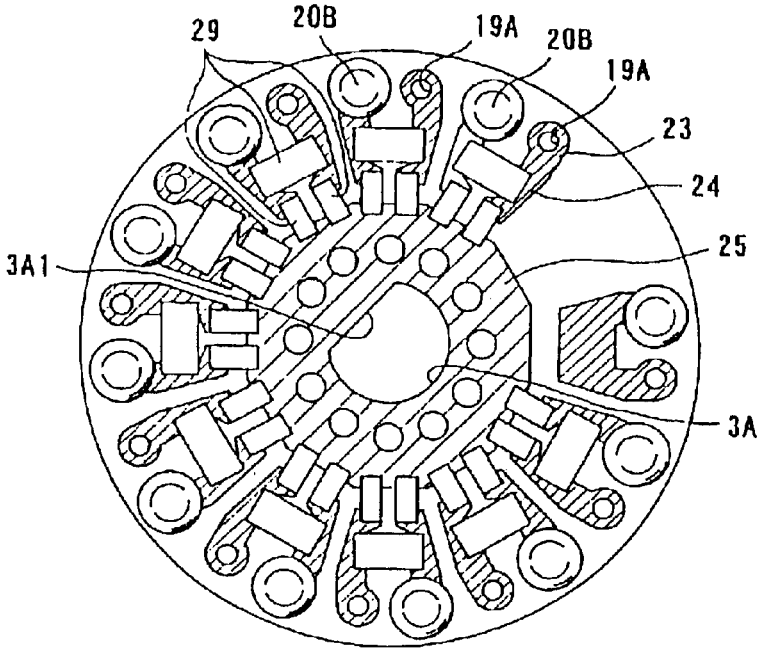

Conductive surface areas 22, 23, as illustrated by slanting lines in FIG. 2, are printed in areas on the terminal board, where the terminals 20A, 20B are to be attached. The conductive surface area 23 on a surface where the terminal 20B is attached has an extension part 24, which extends inward in a radial direction. Electronic part 29 required for an attenuator, such as resistance, is arranged and connects between the extension part 24 on the side of the terminal 20B and the extension part 24 on the side of the terminal 20A, and between the extension part 24 and the central conductive surface area 25. Electrical properties, such as resistance, of the electronic parts arranged to each pair of terminals are different among the electronic devices, and the properties of the input/output terminals gradually change by stepwise rotation of the driving shaft 13 for every contact of the contact shoes with the pair of terminals.

Figure 3:
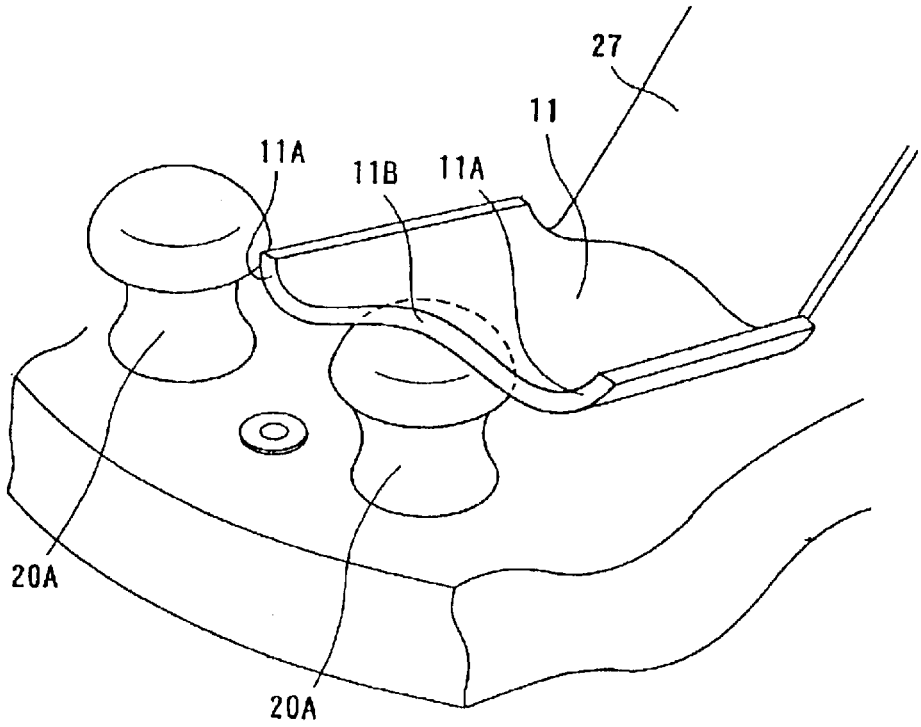
FIG. 3 is a perspective view of a contact shoe of the attenuator.

In FIG. 3, the contact shoes 11, 12 held by the central conductors 9B, 10B of the coaxial connectors 9, 10 are attached to one end of the elastic arm 27, 28, which extends in a radial direction of the terminal board, being angled from the surface of the terminal board. The other ends of the elastic arms 27, 28 are connected and retained to the central conductors 9B, 10B. The elastic arm 27 is positioned inward in the radial direction, and bent at its middle position such that one end is vertical to the other end (here, the elastic arm can be located outward in the radial direction). On the other hand, the elastic arm 28 is positioned outward in the radial direction, and slightly bent, but extends in the radial direction of the terminal board 3. The contact shoes 11, 12 attached to one end of the elastic arms 27, 28 are the same each other. As illustrated in FIG. 3, the contact shoe 11 contacts with the terminal 20A, and is shaped like a wave along the circumferential direction with its ends up in the circumferential direction. Because of this shape, the contact shoe can easily move onto the adjacent terminal at the time of moving towards the adjacent terminal. Accordingly, the contact shoe 11 surely contact with terminal even when the terminal to contact is changed by the stepwise rotational movement of the terminal board 3, and stop at the normal contact position so as to maintain its contacting condition. The width of the contact length in the circumferential direction (distance between the ends 11A) is larger than the diameter of the head part of the terminal, but is designed not to contact with the adjacent terminal when the lower surface of the dent 11B contacts with one terminal at normal position.

For those reasons, the amount of attenuation can be selected by changing the resistance between the input/output terminals or the like through stepwise rotation of the driving shaft 13 under the condition where the input and output coaxial connectors 9, 10 are connected to coaxial cables.

According to the present invention, since a pair of the input and output terminals are arranged on two sides, the distance between those terminals is smaller than before, so that the radius of the terminal board can be smaller. That is, the width of the attenuator device can be smaller. Also, the width of the contact shoe in circumferential direction can be smaller by contacting the contact shoe with the terminal in the radial direction of the terminal board, so that device can be smaller even on this point. Furthermore, since the axes of the coaxial connectors and the driving shaft are supposed to be all located in one surface (hypothetical surface), the size in the above-described width direction can be smaller also in this point. The attenuator device of the present invention can be used alone, but it can be used combining several of them. In this case, the features of the present invention can be fully used.

Figure 4:
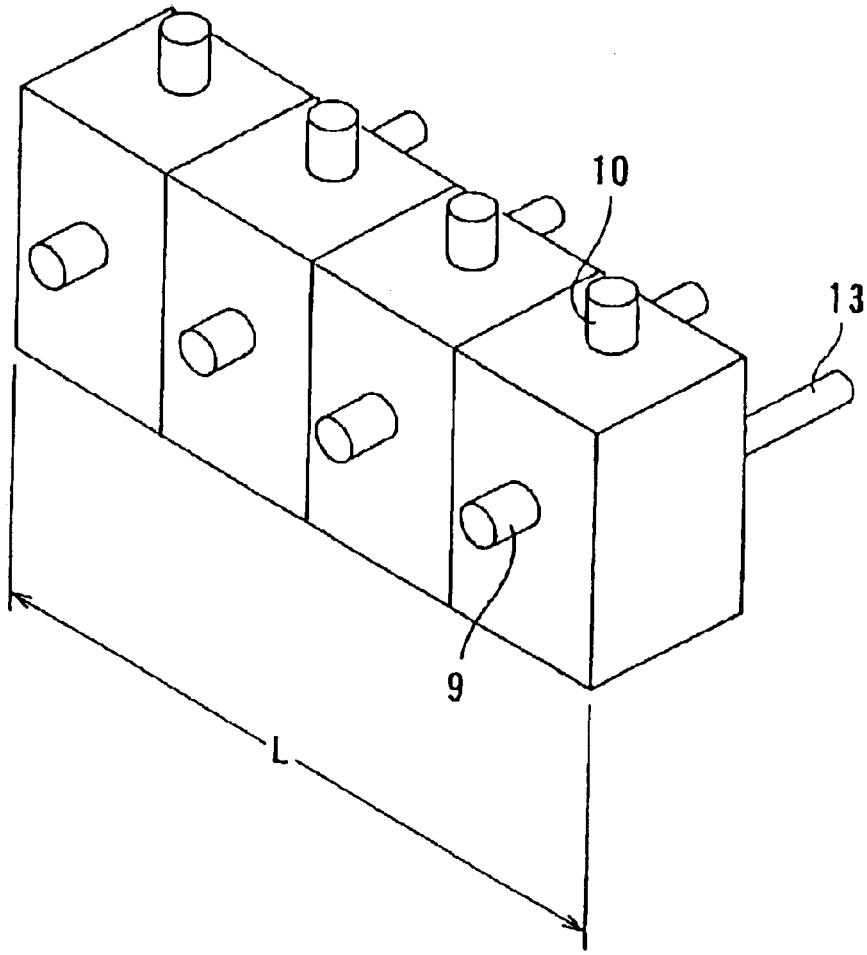
FIG. 4 is a perspective view of the attenuators that are arranged side by side.
Figure 5:
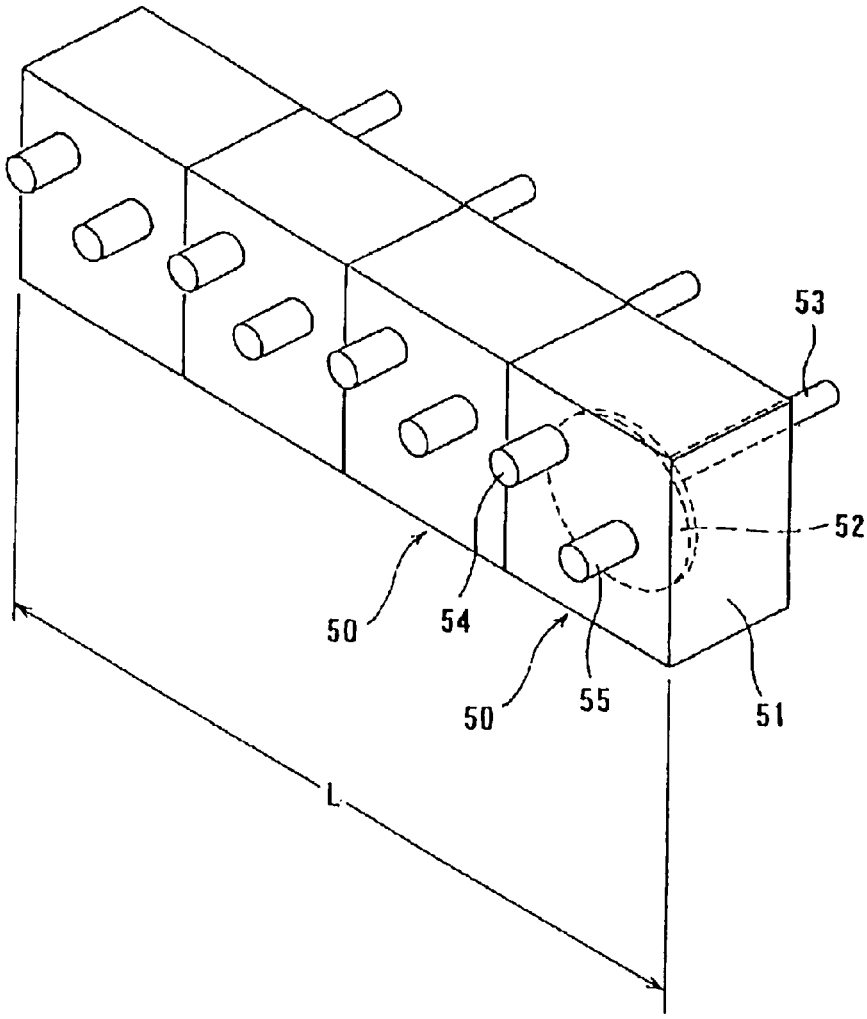
FIG. 5 is a perspective view of the conventional rotary attenuators that are arranged side by side.
Figure 6:
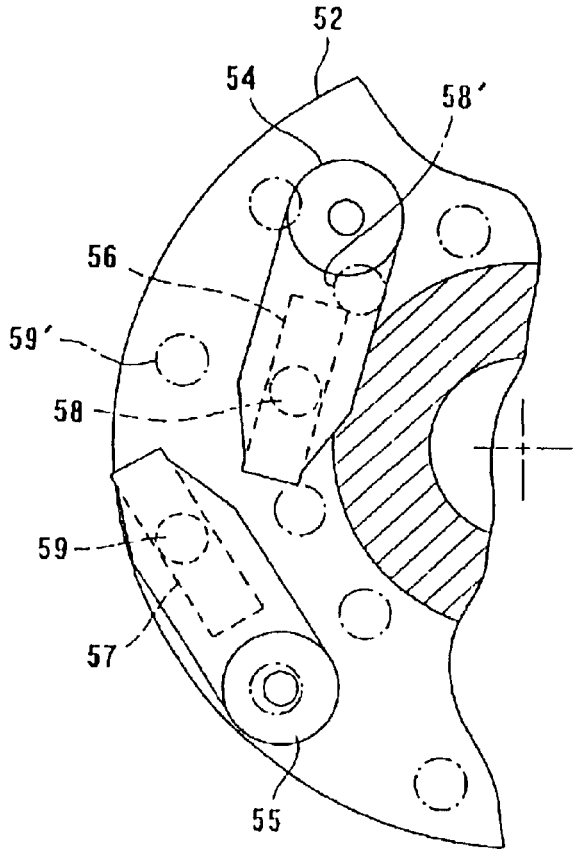
FIG. 6 is a side view of the terminal board and the contact shoe for the conventional attenuator.
Figure 7:
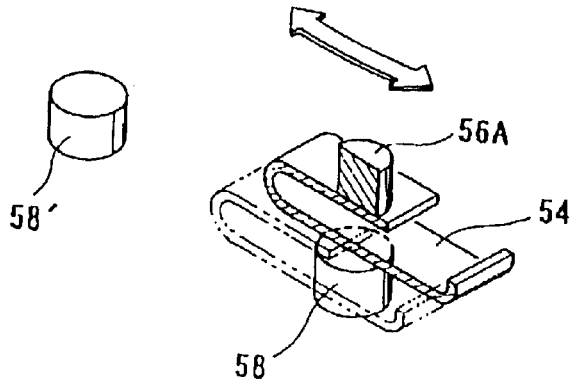
FIG. 7 is a partially cross-section perspective view of the terminal and the contact shoe for the conventional attenuator.

As illustrated in FIG. 4, if a plurality of the attenuators are arranged by contacting the outer surfaces of the housing, from which the coaxial connectors 9, 10 and the driving shaft 13 protrude, the total width L is extremely small due to the narrow width of each attenuator, so that the electronic device, in which those attenuators are used, can be made small in the direction of arranging the attenuators.

As described above, in the present invention, since the input terminal and the output terminal are arranged on different side of the terminal board, the distance between the input terminal and the output terminal of the pair can be shorter. Moreover, if the contact shoe is designed to contact by extending in the radial direction of the terminal board, there is no space required for holding the contact shoe in the circumferential direction. And also, the distance between the pairs of the input terminal and the output terminal can be short when plural pairs of terminals are arranged on the terminal board, as well as the distance between the input terminal and the output terminal of the pair is maintained small. As a result, the size in the radial direction of the terminal board can be extremely small; therefore, the attenuator device can be made small. If all the axes of the input and output coaxial connectors and the driving shaft can be located in one surface, which is parallel to the flat outer surfaces of the housing, the size of the device can be even smaller. In a case that plural attenuators are arranged, a large effect can be expected if they are arranged by contacting each other by their outer surfaces.

What is claimed is:

1. A rotary attenuator device, comprising:

a housing;

a disk-shaped terminal board provided in said housing;

at least one pair of input terminal and output terminal, which is provided along circumferential area of said terminal board;

at least one electronic part which is provided between said input terminal and output terminal and connected to said terminal board;

a driving shaft joined to a center of said terminal board in said housing, said driving shaft being vertical to a surface of said terminal board, and held to freely rotate;

input and output contact shoes elastically contact with said input and output terminals, respectively, said input and output contact shoes being provided to freely slide; and input and output coaxial connectors supported by said housing and having a central conductor, wherein said input and output contact shoes are attached so as to contact with corresponding input and output terminals on different sides of said terminal board.

2. A rotary attenuator device of claim 1, further comprising elastic arms to support said input and output contact shoes at one ends, wherein said elastic arms are formed as cantilevers extending in a radial direction of said terminal board, and are connected and held to said central conductors of said input and output coaxial connectors at the other ends.

3. A rotary attenuator of claim 1, wherein said housing has a pair of flat outer surfaces, which are parallel to and opposed to each other, and each axis of said driving shaft, input coaxial connector and output coaxial connector is in a surface parallel to said pair of outer surfaces.

4. A rotary attenuator device of claim 1, wherein said input and output contact shoes are provided at one end of each said elastic arm, which is formed as a cantilever extending in a radial direction of said terminal board, said elastic arm contacts and connects with said central conductor of said input output coaxial connectors at the other end, said housing has a pair of flat outer surfaces, each axis of said driving shaft, said input coaxial connector and said output coaxial connector is in a surface parallel to said pair of outer surface.

5. A rotary attenuator device, comprising:

a housing;

a disk-shaped terminal board provided in said housing;

at least one pair of input terminal and output terminal attached to said terminal board;

at least one electric part which is respectively provided between input and output terminals of said pair and connected to said terminal board;

a driving shaft, which is joined to a center of said terminal board at its one end so as to be vertical to a surface of said terminal board, protrudes outward from said housing at other end, and held so as to freely rotate;

input and output contact shoes, which elastically contact with said input and output terminals of said pair so as to freely slide; and input and output coaxial connectors, which are held by said housing and each have a central conductor, which extends inside said housing, wherein said housing has a pair of flat outer surfaces, which are parallel to and opposed to each other, and all axes of said driving shaft, said input coaxial connector and said output coaxial connector are located in a same surface parallel to said pair of outer surfaces.

6. A rotary attenuator of claim 5, wherein said input and output contact shoes are provided at ends of elastic arms, which are formed as cantilevers extending in a radial direction of said terminal board, and said elastic arms are connected to and held by said central conductor of said coaxial connector.

7. A rotary attenuator device, comprising:

a housing;

a disk-shaped terminal board provided in said housing;

at least one pair of input terminal and output terminal attached to said terminal board;

at least one electric part which is respectively provided between input and output terminals of said pair and connected to said terminal board;

a driving shaft, which is joined to a center of said terminal board at its one end so as to be vertical to a surface of said terminal board, protrudes outward from said housing at other end, and held so as to freely rotate;

input and output contact shoes, which elastically contact with said input and output terminals of said pair so as to freely slide; and input and output coaxial connectors, which are held by said housing and each have a central conductor, which extends inside said housing, wherein said housing has a pair of flat outer surfaces, which are parallel to and opposed to each other, and all axes of said driving shaft, said input coaxial connector and said output coaxial connector are located in a same surface parallel to said pair of outer surfaces, and wherein said housing is a substantially rectangular parallelepiped block, has outer surfaces which are vertical to each other, and has a pair of optional outer surface parallel to said outer surface of said housing, and said coaxial connectors are respectively provided at said outer surfaces of said housing.

* * * * *